United States Patent [19]

Cooper, deceased et al.

[11] 4,365,610

[45] Dec. 28, 1982

[54] ARROW LAUNCHER

[76] Inventors: Richard W. Cooper, deceased, late of Hutchison, Kans.; by Ruth E. Cooper, Executrix, 29 Tomahawk Rd., Hutchinson, Kans. 67501

[21] Appl. No.: 278,621

[22] Filed: Jun. 29, 1981

[51] Int. Cl.[3] ..... F41B 3/00

[52] U.S. Cl. ..... 124/5; 124/41 R

[58] Field of Search ..... 124/5, 79, 41 R

[56] References Cited

U.S. PATENT DOCUMENTS

| | | | |
|---|---|---|---|
| 2,168,365 | 8/1939 | Stacy-Judd | 124/5 |
| 2,805,517 | 9/1957 | Ruthven | 124/22 X |
| 3,282,262 | 11/1966 | Skinner | 124/5 |

*Primary Examiner*—Richard C. Pinkham
*Assistant Examiner*—William R. Browne
*Attorney, Agent, or Firm*—Harvey B. Jacobson

[57] ABSTRACT

A handgrip body is provided to be held in the user's throwing hand and the handgrip includes an upper head portion supported therefrom having front and rear sides and an outer exposed surface extending between the front and rear sides. The head defines a groove therein extending between the front and rear sides and opening laterally outwardly of the exposed surface. The groove may have a fletched or similarly equipped projectile cradled therein and an elongated flexible and resilient arm has one end portion supported from the head with the other end portion of the arm projecting rearwardly from the head. The terminal portion of the other end of the arm includes a forwardly opening socket for seatingly receiving the rear end of a projectile cradled in the groove.

9 Claims, 8 Drawing Figures

Fig. 4
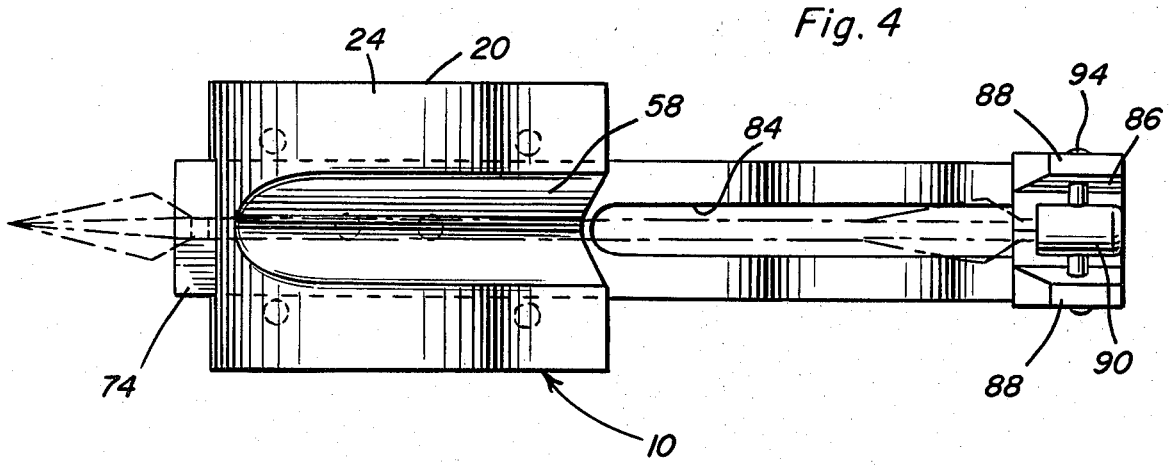
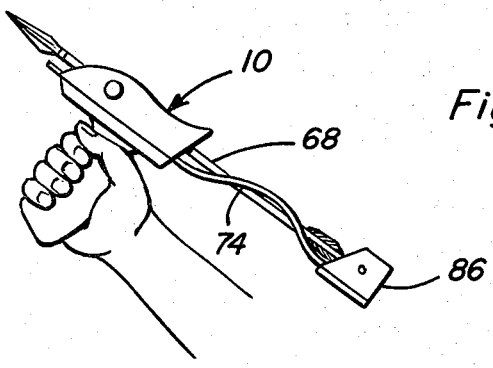
Fig. 6
Fig. 7
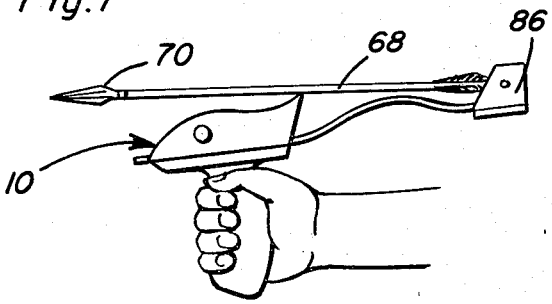
Fig. 5
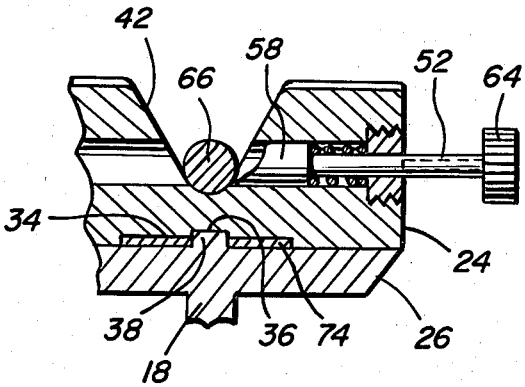
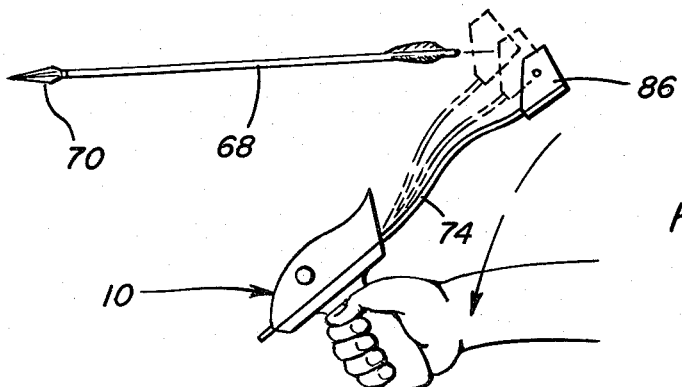
Fig. 8

ARROW LAUNCHER

BACKGROUND OF THE INVENTION

Various forms of games and sporting events may be conducted through the utilization of an elongated projectile such as a spear or arrow. Some of these games and sports require the utilization of both hands of a person playing the game or engaged in the sport and are thus less desirable than projectile games and sporting events wherein only one hand of the person engaged in the game or sport is required. Examples of various forms of game and sport equipment of the object propelling type and designed to be utilized by either one or two hands of the user are disclosed in U.S. Pat. Nos. 1,374,420, 3,099,256, 3,282,262 and 3,557,768.

However, these previously known forms of projectile propelling devices require either the use of two hands or they are not constructed in a manner whereby considerable accuracy may be achieved through utilization of only one hand of the user.

BRIEF DESCRIPTION OF THE INVENTION

The arrow launcher of the instant invention is constructed in a manner whereby it may be utilized in conjunction with different length arrows. The launcher includes an upright handgrip adapted to be held in the throwing hand of the user and the upper end of the handgrip supports a front-to-rear extending head therefrom. The head includes a front-to-rear extending upper surface having an upwardly opening groove formed therein in which the forward portion of a projectile may be cradled and the rear of the head supports a rearwardly projecting flexible and resilient arm including structure at its rear end defining a forwardly opening seat in which to seatingly receive the rear end of the projectile. The rearwardly projecting arm comprises a pair of laterally spaced arm members each having an upwardly bowed midportion and an intermediate length portion of the associated projectile is received between the upwardly bowed midportions of the arm. In use, the launcher is held and moved sharply and in substantially the same manner as the user of the launcher would make an overhand throw, except that the handgrip of the launcher is not released at the end of the throwing stroke. Instead, the projectile is projectiled forwardly from the launcher.

The main object of this invention is to provide an arrow or spear-type launcher which requires utilization of only one hand of the user.

Another object of this invention is to provide an arrow or spear launcher whose structural features enable the launcher to be operated merely by the user thereof holding a handgrip portion of the launcher and executing an arm movement similar to an overhand throw.

Another very important object of this invention is to provide an arrow or spear launcher which may be used in conjunction with arrows or other spear-type projectiles of different lengths.

A final object of this invention to be specifically enumerated herein is to provide a one-hand operable arrow or spear launcher in accordance with the proceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a top plan view of the assemblage illustrated in FIG. 2;

FIG. 5 is an enlarged fragmentary transverse vertical sectional view illustrating the manner in which the arrow or projectile retaining structure may be moved to and held in an inoperative; and FIGS. 6, 7 and 8 are side elevational views illustrating sequential positions of the arrow launcher when actuated by a user for the purpose of launching an arrow or spear-type projectile.

DETAILED DESCRIPTION OF THE INVENTION

Figure 1:
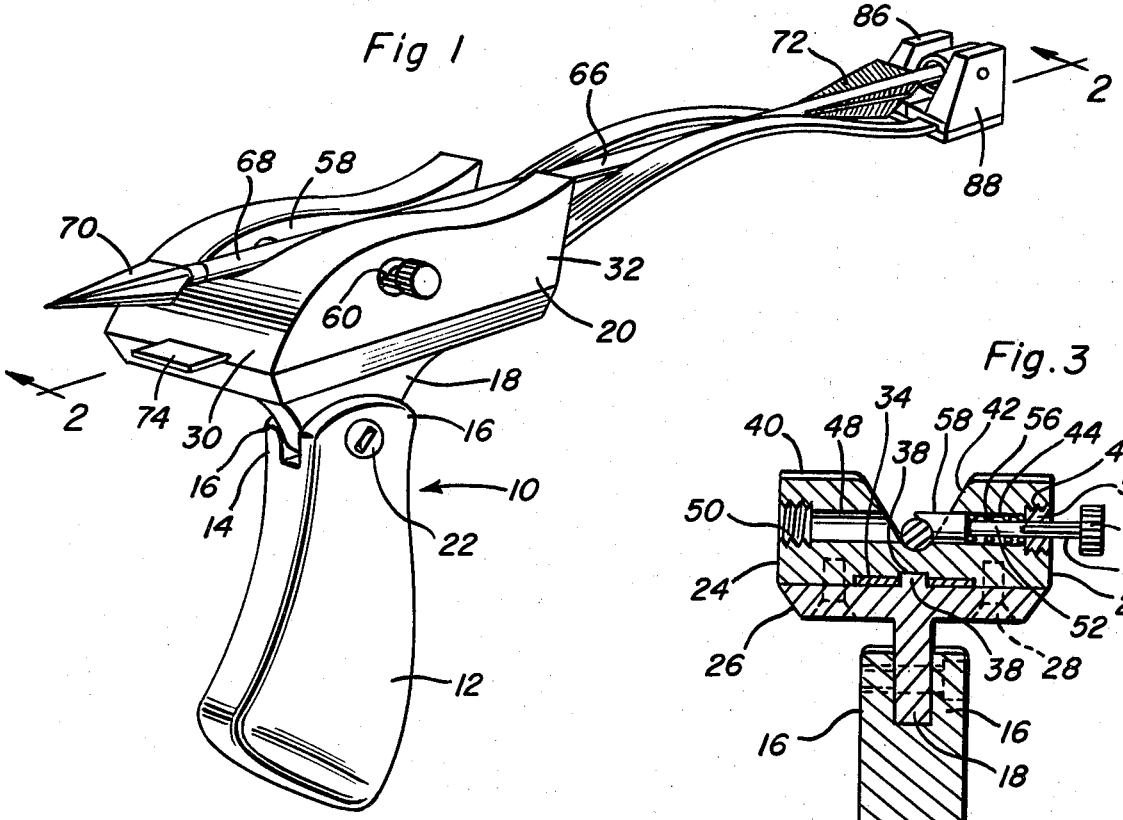
FIG. 1 is a perspective view of the arrow launcher of the instant invention.

Referring now more specifically to the drawings, the numeral 10 generally designates the arrow launcher of the instant invention. The launcher 10 includes a contoured upstanding handgrip 12 including a bifurcated upper end 14 between whose furcations 16 a depending apertured mounting lug 18 of an upper head 20 is secured through the utilization of a threaded fastener 22. The head 20 includes upper and lower portions 24 and 26 removably secured together by opposite side pairs of threaded fasteners 28 secured upwardly through the lower portion 26 and threadedly engaged in suitable threaded blind bores formed in the upper portion 24.

The head 20 is elongated and includes front and rear ends 30 and 32 and the undersurface of the upper portion 24 has a downwardly opening front-to-rear extending groove 34 formed therein. In addition, the longitudinal central portion of the groove 34 includes a downwardly opening blind bore 36 and the upper surface of the lower portion 26 includes an upstanding projection 38 which is keyed in the blind bore 36.

The head 20 includes an upper surface 40 in which an elongated front-to-rear extending groove 42 is formed and one side portion of the upper portion 24 includes a transverse bore 44 which opens into the groove 42 through one side thereof at its inner end and includes a threaded counterbore 46 at its outer end which opens outwardly through one side of the upper portion 24. In addition, the opposite side of the upper portion 24 includes a similar bore 48 including a similar threaded counterbore 50.

A headed plunger 52 is reciprocal in the bore 44 and a threaded sleeve 54 is threaded in the counterbore 46, a compression spring 56 being disposed about the shank 52 between the inner end of the sleeve 54 and the head 58 on the shank 52. The sleeve 54 includes a keyway 60, see FIG. 1, and the shank 52 includes a key 62 registerable with and slidably receivable within the keyway 60, the outer end of the shank 52 being provided with a finger engageable knob 64. When the knob 64 is pulled outwardly to retract the shank 52 outwardly of the bore 44 and the knob 64 is turned to misalign the key 62 with the keyway 60, the sleeve 52 is held in the outer position thereof with the head 58 thereof fully retracted in the end of the bore 44 which opens into the groove 42. In this position, the head 50 is in the inactive position. However, when the knob 64 is turned to align the key 62 with the keyway 60, the shank 52 may move inwardly of the bore 54 under the biasing action of the spring 56 in order to allow the head 58 to engage over the shaft 66 of a projectile 68 cradled in the groove 42, the projectile 68 including a head 70 on its forward end and fletching 72 on its rear end.

The launcher 10 also includes an elongated flexible and resilient strap-type arm 74 including front and rear ends 76 and 78. The front end 76 of the arm 74 includes a plurality of longitudinally spaced apertures 80 formed therein and the projection 38 is received through one of the apertures 80. Further, the front end 76 of the arm 74 is received in the groove 34. In this manner, the front end of the arm 76 may be clamped between the upper and lower portions 24 and 26 of the head 20 in longitudinally adjusted position relative thereto. The rear end of the arm 78, rearward of the head 20, is longitudinally bowed to include an upperly convex sine wave 82 and longitudinally slotted as at 84 to define a pair of generally parallel arm elements. The rear ends of the arm elements are interconnected by a bifurcated mount 86 secured thereto and between whose furcations 88 an abutment 90 is pivotally supported. The abutment 90 defines a forwardly opening recess 92 and the cross pin 94 by which the abutment for cup 90 is oscillatably supported between the furcations 88 extends through the recess 92. The rear terminal end of the projectile 68 is abutted against the pin 94.

In operation, the projectile 68 may be loaded into position on the launcher 10 in the manner illustrated in FIG. 1 of the drawings with the rear terminal end of the projectile 68 abutted against the cross pin 94. Then, with a sharp forward and downward movement such as that sequentially illustrated in FIGS. 6, 7 and 8 of the drawings, the launcher 10 may be utilized to propel the projectile 68 from the launcher 10. Because of the fletching 72 on the rear end of the projectile 68, the latter will fly a true course. In addition, inasmuch as the arm 74 is longitudinally slotted as at 84, the rear bowed portion of the arm 74 tends to stabilize the projectile 68 during the user's manipulation thereof in the manner illustrated in FIGS. 6, 7 and 8.

Figure 3:
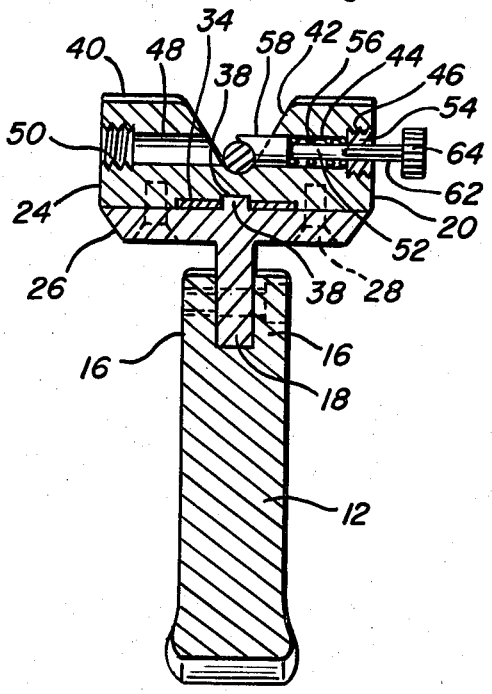
FIG. 3 is a transverse vertical sectional view taken substantially upon the plane indicated by the section line 3—3 of FIG. 2.
Figure 2:
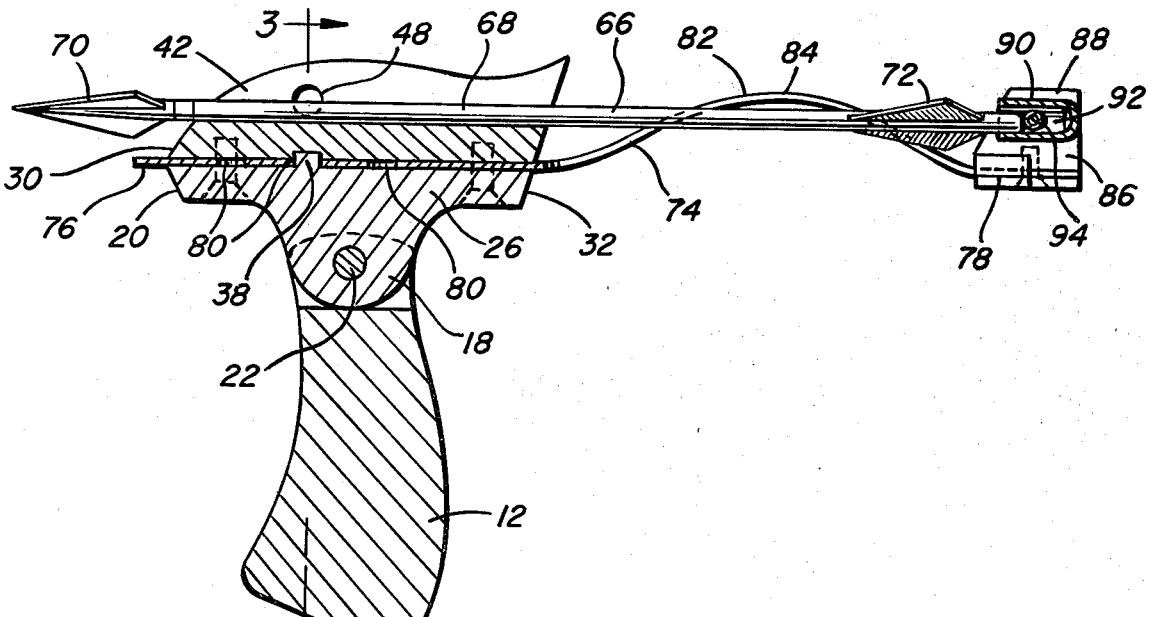
FIG. 2 is a longitudinal vertical sectional view taken substantially from the plane indicated by the section line 2—2 of FIG. 1.

The length of the arm 74 may be adjusted accordingly to the length of the projectile 68 to be used by engaging the projection 38 in a selected one of the bores 80 and then resecuring the upper and lower portions 24 and 26 of the head 20 together. The head 58 may be utilized in the manner illustrated in FIG. 3 of the drawings to maintain the projectile 68 in the ready position preparatory to projection of the projectile 68. When it is desired to project the projectile 68 from the launcher 10, the knob 64 is grasped, pulled outwardly and turned so as to misalign the key 62 with the keyway 60 and thereby retain the head 58 in the retracted position thereof illustrated in FIG. 5 of the drawings. Also, it will be noted that the shank 52 and sleeve 54 may be disposed in the bore 48 and the counterbore 50 in order to adapt the launcher 10 for use by a left-handed person.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A launcher for an elongated projectile of the type including front and rear end portions and wherein the projectile includes a fletched or similarly equipped rear end, said launcher including a handgrip body held in the users throwing hand, said handgrip including a head portion supported therefrom having front and rear sides and an outer exposed surface extending between said front and rear sides, said head defining a groove therein between said front and rear sides, opening laterally outwardly of said exposed surface and adapted to lengthwise cradle a projectile therein, an elongated flexible and resilient arm having opposite end portions, said arm having sufficient rigidity to be self supporting said head including means for supporting one end portion of said arm with the other end portion of said arm projecting rearwardly from said head, said other end portion of said arm including forwardly opening socket means for seatingly receiving the rear end of a projectile cradled in said groove, said launcher being given a forward arcuate motion to project a projectile.

2. The combination of claim 1 wherein said arm includes a sine wave bow therein and said other end of said arm is longitudinally slotted.

3. The combination of claim 1 wherein said socket means and said other end of said arm include means pivotally supporting said socket means from said arm for oscillation about an axis transverse to said arm.

4. The combination of claim 1 wherein said other end portion of said arm includes a pair of parallel flexible and resilient arm elements, said socket means being connected between the corresponding ends of said arm elements.

5. The combination of claim 1 wherein said head includes releasable locking means for retaining a projectile seated in said groove.

6. The combination of claim 1 wherein said means for supporting the arm includes means operative to lengthwise adjustably shift said arm relative to said head.

7. The combination of claim 6 wherein said arm includes a sine wave bow therein and said other end of said arm is longitudinally slotted.

8. The combination of claim 6 wherein said socket means and said other end of said arm include means pivotally supporting said socket means from said arm for oscillation about an axis transverse to said arm.

9. The combination of claim 6 wherein said other end portion of said arm includes a pair of parallel flexible and resilient arm elements, said socket means being connected between the corresponding ends of said arm elements.

* * * * *